United States Patent [19]

Muramoto et al.

[11] Patent Number: 5,063,730

[45] Date of Patent: Nov. 12, 1991

[54] OPENABLE ROOF APPARATUS

[75] Inventors: Hiroki Muramoto, Hiroshima; Kenichi Sugizaki, Tokyo, both of Japan

[73] Assignees: Mitsubishi Jukogyo Kabushiki Kaisha; Shimizu Construction Co., Ltd., both of Japan

[21] Appl. No.: 502,170

[22] Filed: Mar. 29, 1990

[30] Foreign Application Priority Data

| | | | |
|---|---|---|---|
| Mar. 30, 1989 | [JP] | Japan | 1-79259 |
| Mar. 30, 1989 | [JP] | Japan | 1-79260 |
| Mar. 30, 1989 | [JP] | Japan | 1-79263 |
| Mar. 30, 1989 | [JP] | Japan | 1-79264 |

[51] Int. Cl.[5] ..... E04B 7/16

[52] U.S. Cl. ..... 52/66; 52/6

[58] Field of Search ..... 52/6, 7, 8, 9, 10, 80, 52/81, 66

[56] References Cited

U.S. PATENT DOCUMENTS

| | | | |
|---|---|---|---|
| 4,676,033 | 6/1987 | Allen | 52/6 |
| 4,716,691 | 1/1988 | Allen | 52/6 |
| 4,738,057 | 4/1988 | Logan | 52/66 |

*Primary Examiner*—John E. Murtagh

*Attorney, Agent, or Firm*—Scully, Scott, Murphy & Presser

[57] ABSTRACT

In an openable roof apparatus for a space, a first and a second movable roof structures have their respective both ends which are supported respectively by a pair of stationary support structures for movement therealong. A pair of guide arrangements are arranged respectively on the pair of stationary support structures. The first and second movable roof structures are movable toward and away from each other along the guide arrangements. The first movable roof structure includes a plurality of movavble roof units having their respective axes which extend perpendicularly to the guide arrangements. The first and second movable roof structures are movable between a closed position where the movable roof units of the first movable roof structure cooperate with the second movable roof structure to close the space, and an open position where the movable roof units of the first movable roof structure are moved away from the second movable roof structure to open the space. In the open position, the movable roof units of the first movable roof structure are overlapped with each other.

29 Claims, 11 Drawing Sheets

OPENABLE ROOF APPARATUS

BACKGROUND OF THE INVENTION

The present invention relates to an openable roof apparatus comprising a movable roof arrangement which is constructed above a large space or equipment or establishment such as a stadium, a concert hall, an event site or the like and which can freely be moved between an open position where the space is open and a closed position where the space is closed.

An openable roof apparatus can fulfill such various demands that it is possible to obtain an open feeling of the outdoors, fresh air, and so on, and it is possible also to remove or eliminate an evil due to rainy weather. These demands are contrary to each other. Many openable roof apparatuses have already been provided or proposed.

For instance, an openable roof apparatus is known which is of collapsible type comprising a roof structure. The roof structure is composed of a plurality of plane plates which are folded up and extended or expanded to move the roof structure between an open position where a space or roof building subject such as a stadium, a concert hall, an event site or the like is open and a closed position where the space is closed.

Alternatively, as shown in FIG. 16 of the drawings attached hereto, an openable roof apparatus comprises a roof structure which is composed of a stationary roof section 1 and a movable roof section 2. The movable roof section 2 is moved to a position above or within the stationary roof section 1 to open a part of the space S.

Further, as shown in FIGS. 17 and 18, an openable roof apparatus is also known which comprises a movable roof section. The movable roof section is composed of at least two roof units 3 and 3 each of which is formed into a sectorial shape. The roof units 3 are moved angularly about a post 4 which is located at a center of the sectorial shape, whereby the movable roof section can open and close the space S. The roof units 3 jointly use the common center of angular movement. Moreover, a first support leg 5 and a second support leg 6 supporting each roof unit 3 are arranged respectively adjacent an arc of the sectorial shape forming the roof unit 3 and adjacent the center of the angular movement. The first and second legs 5 and 6 are provided respectively with slide mechanisms which are movable respectively along arcuate tracks 7 and 8.

By the way, in such conventional openable roof apparatuses, an early object can be achieved in that the roof structure can be moved between the open and closed positions. However, the conventional openable roof apparatuses have the following problems.

That is, in the openable roof apparatus of collapsible type, an accommodating section is newly required for the collapsible roof structure. Further, not only an operating mechanism becomes troublesome or cumbersome, but also a form of the roof structure is limited to a flat or plain configuration in the form of plates from the viewpoint of its construction. The openable roof apparatus lacks in its decorative design when the building is viewed as a whole.

Further, in the openable roof apparatus shown in FIG. 16, since an escaping space is required for the movable roof section 2 to be withdrawn or removed, a precise or valuable space is sacrificed. Further, since the roof arrangement becomes its form in which the movable roof section 2 is supported by the stationary roof section 1, it is required that the stationary roof section 1 is strengthened in its construction. Moreover, since the movable roof section 2 becomes also its form in which the movable roof section 2 is supported in a cantilever manner, its construction is required to be strengthened. Thus, the cost increases.

On the other hand, the openable roof apparatus shown in FIGS. 17 and 18 has such an advantage that it is possible to easily and optionally move the roof units 3 between the open and closed positions with respect to the space S. However, the following various problems to be improved arise. That is, the stability of the roof structure in the closed position, driving of the roof units 3, and so on are deteriorated so that the openable roof apparatus is not necessarily practical in use. Further, presence of the post 4 at the center of angular movement of the roof units 3 serves as a large restriction or limitation when the space S is designed above which the movable roof structure is built. Moreover, in the type in which each of the roof units 3 is supported at its center of angular movement, there are such problems that stress is concentrated with respect to the post 4 at the center of angular movement, stress is concentrated with respect to a central section of the roof unit 3 per se, and so on. Accordingly, it becomes difficult to design the movable roof structure at low cost from the viewpoints of its construction, at reduction in weight, and so on. Furthermore, in order to move the movable roof structure between its open and closed positions by 100%, it is required that a sidewall section of the movable roof unit 3 is also moved, simultaneously with the roof unit 3, between a closed position where the sidewall section surrounds the space S and an open position where the sidewall section is moved away from the space S. Accordingly, the cost increases.

By the way, a point, to which attention must be paid, resides in how the roof arrangement is supported which has its weight of the order of several tens of tons to several hundreds of tons, and how the roof arrangement is moved smoothly as occasion demands.

FIG. 19 shows an example of a support arrangement of the conventional openable roof apparatus. In FIG. 19, a movable roof 31 has its ends which is supported by a truck 33 through a pin 32. The truck 33 rests on a rail 35 in a transportable manner, which is laid on a horizontal surface 34a of a support structure 34, so that the truck 33 is movable along the support structure 34. The truck 33 has its left-hand, right- hand and upper portions to which three guide rollers 36 are mounted respectively. Three guide rails 37 in contact respectively with the guide rollers 36 are laid respectively on left-hand and right-hand vertical surfaces 34b and 34c and an upper horizontal surface 34d. Thus, the movable roof 31 can smoothly be moved against horizontal force and tension force. In the conventional openable roof apparatus shown in FIG. 19, however, only one truck 33 is provided at the end of the movable roof 31, and the roof apparatus comprises fundamentally a single support structure. Thus, the movable roof 31 increases in its construction. Accordingly, in case where a load applied to the truck 33 is excessive, or in case where the movable roof 31 per se has its complicated structure so that loads in various directions are applied to the truck 33, there is such a fear that reliability with respect to support and movement of the movable roof 31 cannot sufficiently be ensured.

Furthermore, FIG. 20 shows another example of a support arrangement of the conventional openable roof apparatus which comprises a movable roof 41. The movable roof 41 has its end which is supported by a truck 43 through a pin 42. The truck 43 has a pair of wheels 44 and 44 which rest, in a transportable manner, respectively on a pair of rails 46 and 46 laid on an oblique or inclined surface 45a of a support structure 45. Thus, the movable roof 41 is movable along the support structure 45. A groove 47 is formed in the support structure 45 at a location between the pair of rails 46 and 46. A guide roller 48 is arranged on the truck 43 and projects into the groove 47. A pair of guide rails 49 and 49 are laid within the groove 47 so as to clamp the guide roller 48. Thus, the movable roof 41 can smoothly be moved against horizontal force and tension force.

In the openable roof apparatus shown in FIG. 20, however, the movable roof 41 is supported by the truck 43 through the pin 42. Accordingly, in case where the movable roof 41 increases in its construction so that a load applied to the pin 42 is excessive, the pin 42 must be strengthened in its construction. This leads to an increase in weight of the movable arrangement as a whole so that the movable arrangement becomes complicated. Further, in case where the movable roof 41 per se has its complicated structure so that loads in various directions are applied to the pin 42, there is such a fear that reliability with respect to support and movement of the movable roof 41 cannot sufficiently be ensured.

On the other hand, although not limited to the openable roof apparatus, a mechanism for moving a construction, which is large in weight, is generally complicated in its structure, so that it is difficult to apply the mechanism to the openable roof apparatus in view of economical efficiency and reliability.

SUMMARY OF THE INVENTION

It is therefore an object of the invention to provide an openable roof apparatus for a space, in which it is possible to take large an area of the open space, the sense of vision of the openable roof apparatus is superior, and an accommodating area for a movable roof arrangement can be reduced.

It is another object of the invention to provide an openable roof apparatus for a space, in which an affection or influence of the shade can be reduced to the utmost, whereby it is possible to reduce a shady area or region within the space.

It is still another object of the invention to provide an openable roof apparatus for a space, which is applicable to the space large in size, which is simple in structure or construction, and in which it is possible to realize smooth opening and closing operation.

For the purpose, according to the invention, there is provided an openable roof apparatus for a space having a central axis, comprising:

a pair of stationary parallel support structures arranged respectively on both sides of the space and extending in parallel relation to each other;

a first and a second movable roof structures having their respective both ends which are supported respectively by the pair of stationary support structures for movement therealong; and a pair of guide means arranged respectively on the pair of stationary support structures and extending perpendicularly to a plane including the central axis of the space, the first and second movable roof structures being movable toward and away from each other along the pair of guide means, wherein the first movable roof structure includes a plurality of movable roof units having their respective axes which extend perpendicularly to the pair of guide means, wherein the first and second movable roof structures are movable between a closed position where the movable roof units of the first movable roof structure cooperate with the second movable roof structure to close the space, and an open position where the movable roof units of the first movable roof structure are moved away from the second movable roof structure to open the space, and wherein, in the open position, the movable roof units of the first movable roof structure are overlapped with each other, With the above arrangement of the invention, in the case where there is such a fear that an influence of the shade is exerted upon the space for the reason that the sun is located at the lower position, the second movable roof structure is moved from the closed position on the space to the open position, whereby it is possible to restrain the influence of the shade to the utmost. Thus, it is possible to restrain the influence of the shade region within the space to the utmost.

Preferably, the second movable roof structure includes a plurality of movable roof units which, in the open position, are overlapped with each other. The pair of stationary support structures extend in one direction in parallel relation to each other. The pair of stationary support structures are formed respectively with surface means extending in the one direction. The openable roof apparatus further includes a pair of truck means supported respectively by the surface means of the respective stationary support structures and movable respectively along the surface means. The both ends of the respective first and second movable roof structures are supported respectively by the pair of truck means. A pair of load-equalizing means are arranged respectively between the pair of truck means and the both ends of the respective first and second movable roof structure for equalizing loads applied respectively to the pair of truck means. With the above arrangement of the invention, the both ends of each of the movable roof units are supported respectively by the pair of truck means. Further, even in the case where loads from the movable roof units are complicated, the loads can equally be dispersed to the truck means by the load equalizing means. Thus, even in the case where the movable roof units are large in size and complicated, the movable roof units can be moved smoothly and reliably.

Preferably, the second movable roof structure includes a plurality of movable roof units which, in the open position, are overlapped with each other. The pair of stationary support structures have their respective upper surfaces. Each of the pair of guide means has a plurality of groove means formed in a corresponding one of the upper surfaces of the respective support structures. The openable roof apparatus further includes a plurality of truck means each of which is associated with a corresponding one of the both ends of a corresponding one of the movable roof units of the first and second roof structures. The plurality of truck means are received respectively in the plurality of groove means for movement therealong between the open and closed positions.

With the above arrangement of the invention, a support arrangement for the movable roof units can be made simple and can be reduced in weight. Even if the loads from the movable roof units are complicated, the loads can smoothly be transmitted to the truck means. Thus, even if the movable roof units are large in size and complicated, the movable roof units can be moved smoothly and reliably.

DETAILED DESCRIPTION

Figure 1:
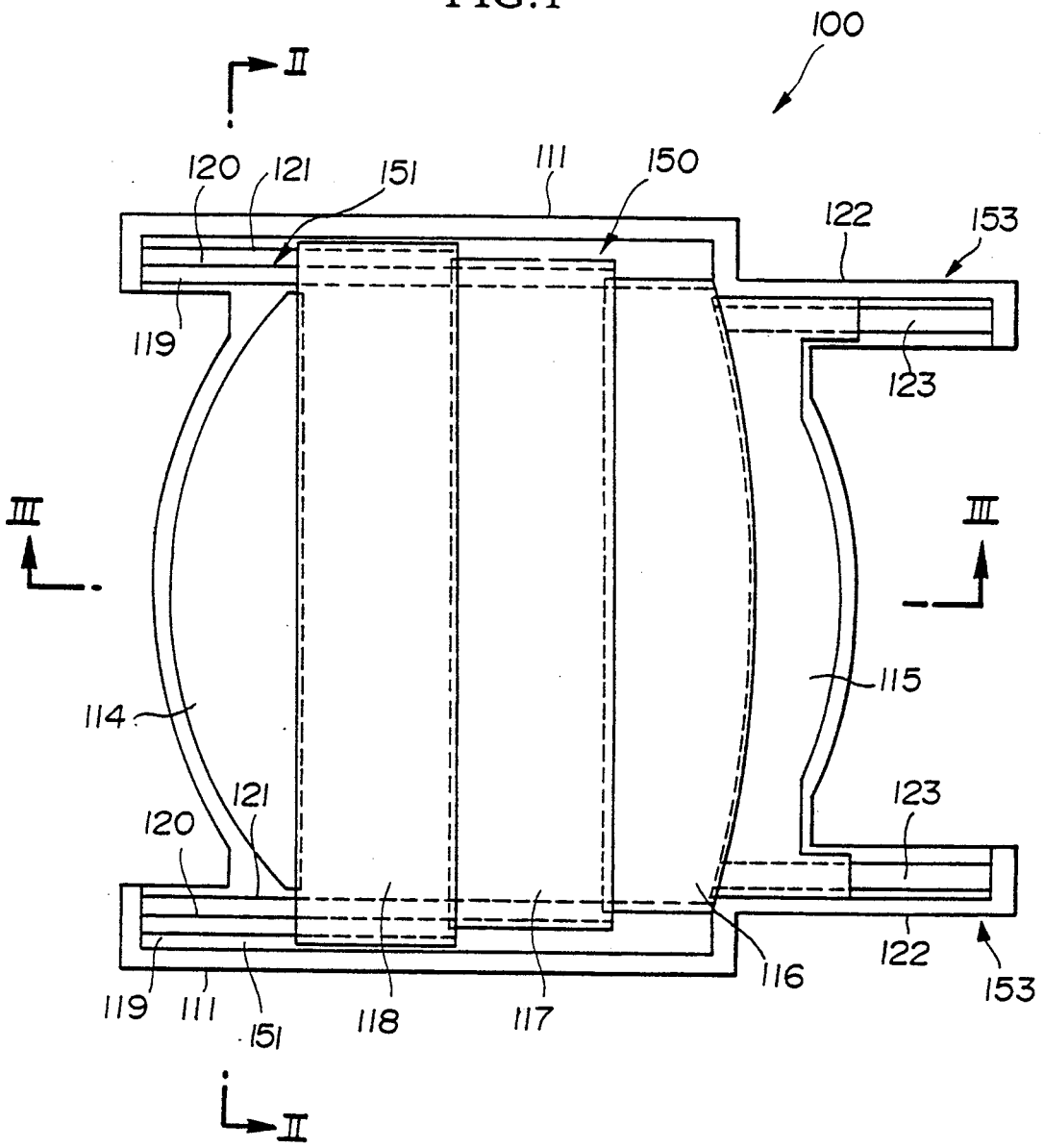
FIG. 1 a top plan view of an openable roof apparatus according to a first embodiment of the invention, showing first and second movable roof structures moved to a closed position.

Referring first to FIG. 1, there is shown, in plan, an openable roof apparatus, generally designated by the reference numeral 100, according to a first embodiment of the invention. The openable roof apparatus 100 is applied to a large space 112 (refer to FIGS. 2 and 3) such as, for example, a stadium, which is substantially elliptic in plan. The space 112 is formed into an ellipse in plan as a whole. The space 112 is one in which a plurality of audience seats are provided around a sports stadium.

A pair of stationary parallel support structures 111 and 111 are arranged respectively on both sides of the space 112 and extending in parallel relation to each other. A first and a second movable roof structures 150 and 115 have their respective both ends which are supported respectively by the pair of stationary support structures 111 and 111 for movement therealong.

A pair of guide arrangements 151 and 151 are arranged respectively on the pair of stationary support structures 111 and 111 and extend perpendicularly to a plane including the central axis of the space 112. The pair of guide arrangements 151 and 151 extend horizontally. The first and second movable roof structures 150 and 115 are movable toward and away from each other along the pair of guide arrangements 151 and 151.

Figure 2:
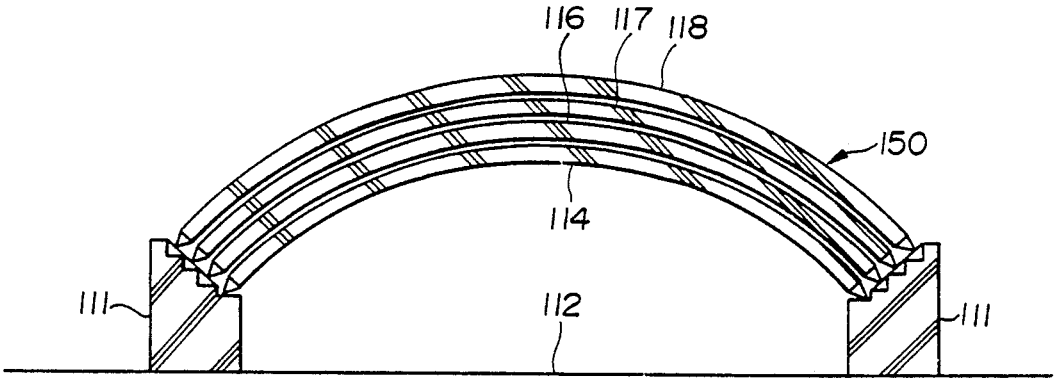
FIG. 2 is cross-sectional view taken along the line II—II in FIG. 1.

The first movable roof structure 150 includes at least two, three in the illustrated embodiment, first, second and third movable roof units 116, 117 and 118 which have their respective axes which extend perpendicularly to the pair of guide arrangements 151 and 151. Each of the first, second and third movable roof units 116, 117 and 118 of the first movable roof structure 150 has an arcuate cross-sectional shape that is a division of a spherical surface as shown in FIG. 2. The first and second movable roof structures 150 and 115 are movable between a closed position where the movable roof units 116, 117 and 118 of the first movable roof structure 150 cooperate with the second movable roof structure 115 to close the space 112, and an open position where the movable roof units 116, 117 and 118 of the first movable roof structure 150 are moved away from the second movable roof structure 115 to open the space 112. In the open position, the movable roof units 116, 117 and 118 of the first movable roof structure 150 are overlapped with each other as shown in FIG. 2.

The movable roof units 116, 117 and 118 of the first movable roof structure 150 are formed into an outer configuration at the closed position, which covers an upper portion of the space 112 as a whole.

A stationary roof structure 114 is arranged on one of both sides of the space 112 at a location on the opposite side of the space 112 from the second movable roof structure 115. The stationary roof structure 114 extends between the pair of stationary support structures 111 and 111 perpendicularly thereto. In the closed position, the stationary roof structure 114 cooperates with the second movable roof structure 115 and the movable roof units 116, 117 and 118 of the first movable roof structure 150 to close the space 112. In the open position, the movable roof units 116, 117 and 118 of the first movable roof structure 150 are overlapped with each other at a location above the stationary roof structure 114 as shown in FIG. 3.

The stationary roof structure 114 and the second movable roof structure 115 cover respectively the left-hand and right-hand end portions of the space 112. In the closed position, the movable roof units 116, 117 and 118 of the first movable roof structure 150 cooperate with each other to cover a central portion of the space 112.

Figure 3:
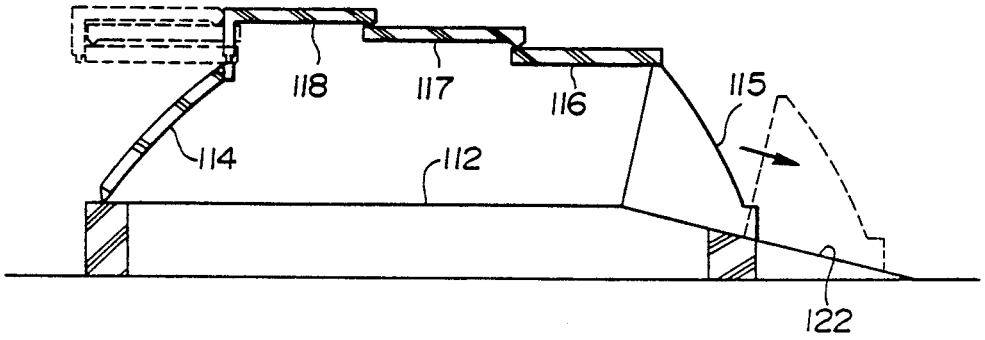
FIG. 3 is a cross-sectional view taken along the line III—III in FIG. 1.

More specifically, as shown in FIGS. 2 and 3, the first movable roof structure 150 is composed of the first, second and third movable roof units 116, 117 and 118. In the open position, the first movable roof unit 116 is overlapped with the stationary roof structure 114 which is located at one end of the space 112, that is, at the left-hand end thereof in FIG. 1. Referring back to FIGS. 2 and 3, in the closed position, the first movable roof unit 116 is located adjacent the second movable roof structure 115 which is located at the other end of the space 112, that is, at the right-hand end thereof in FIG. 1. In the closed position, the second movable roof unit 117 is located adjacent the first movable roof unit 116. In the open position, the second movable roof unit 117 is overlapped with the first movable roof unit 116. In the closed position, the third movable roof unit 118 is located adjacent the second movable roof section 117. In the open position, the third movable roof unit 118 is overlapped with the second movable roof unit 117.

Further, as clearly illustrated in FIG. 1, in the closed position, the first movable roof unit 116 has its side located adjacent a side of the second movable roof structure 115. The side of the first movable roof unit 116 projects arcuately in plan toward the side of the second movable roof structure 115, and the side of the second movable roof structure 115 is concave arcuately in plan correspondingly to the projecting side of the first movable roof unit 116.

In connection with the above, the manner of overlapping of the first through third movable roof units 116, 117 and 118 is optional. Any one of the first through third movable roof units 116, 117 and 118 may be located at the uppermost position or at the lowermost position.

The movable roof units 116 through 118 have their respective both ends which are supported respectively by the pair of stationary support structure 111 and 111 under such a condition that the movable roof units 116 through 118 are movable in the extending direction of the pair of stationary support structures 111 and 111. That is, each of the pair of guide arrangements 151 and 151 includes a plurality of guide rails 119, 120 and 121 corresponding in number to the plurality of movable roof units 116, 117 and 118 of the first movable roof structure 150. Each of the movable roof units 116, 117 and 118 has both ends which are supported by a corresponding one of the guide rails 119, 120 and 121 on one of the pair of stationary support structures 111 and a corresponding one of the guide rails 119, 120 and 121 on the other stationary support structure 111.

A plurality of wheels (not shown) are mounted to the both ends of the respective movable roof units 116 through 118, and are laid on the guide rails 119 through 121. The wheels travel along the guide rails 119 through 121, whereby the movable roof units 116 through 118 are movable along the extending direction of the pair of support structures 111 and 111.

The pair of stationary support structures 111 and 111 have their respective extensions 153 and 153 which are located respectively at the both ends of the second movable roof structure 115. The extensions 153 and 153 have their respective upper surfaces 122 and 122 which are inclined downwardly away from the space 112. The second movable roof structure 115 has its both ends which are supported respectively on the inclined upper surfaces 122 and 122 of the respective extensions 153 and 153 for movement therealong between the closed and open positions. The extensions 153 and 153 of the respective stationary support structures 111 and 111 extend to their respective positions which are spaced sufficiently away from the space 112. In this connection, the extensions 153 and 153 of the respective stationary support structures 111 and 111 extend to such a location that movement of the second movable roof structure 115 toward and away from the first movable roof unit 116 of the first movable roof structure 150 does not cause the shade to occur within the space 112.

The second movable roof structure 115 is so constructed as to be movable along the inclined upper surfaces 122 and 122, whereby the second movable roof structure 115 is movable toward and away from the upper portion of the space 112. That is, the pair of guide arrangements 151 and 151 includes a pair of rack-type rails 123 and 123 arranged respectively on the inclined upper surfaces 122 and 122 of the extensions 153 and 153 of the respective stationary support structures 111 and 111. The second movable roof section 115 has its both ends which are supported respectively by the pair of rack-type rails 123 and 123. The second movable roof structure 115 has its both lower ends which are provided respectively with driving mechanisms (not shown). The driving mechanisms are engaged respectively with the rack-type rails 123 and 123. By operation of the driving mechanisms, the second movable roof structure 115 is movable along the inclined upper surfaces 122 and 122 of the respective stationary support structures 111 and 111.

The operation of the openable roof apparatus 100 according to the first embodiment, constructed as above will be described below.

In the case where the second movable roof structure 115 and the movable roof units 116 through 118 of the first movable roof structure 150 are located above the space 112 as shown in FIG. 1, the second movable roof structure 115 and the movable roof units 116 through 118 cooperate with the stationary roof structure 114 to cover the upper portion of the space 112, to form a large roof arrangement on the space 112. By doing so, the space 112 can take shelter from the rain and wind. Thus, even if it is bad in weather, people can sufficiently enjoy a match or contest and a watch.

On the other hand, in order to move the first and second movable structures 150 and 115 to the open position, driving mechanisms (not shown), which are located respectively at the both ends of the movable roof units 116 through 118 are operated to move the movable roof units 116 through 118 toward the stationary roof unit 114 which is located at the one end of the space 112. As a result, the movable roof units 116 through 118 are moved to the open position where the movable roof units 116 through 118 are overlapped with the stationary roof structure 114. By doing so, a space between the stationary and movable roof structures 114 and 115 are open largely so that the roof arrangement is removed from the upper portion of the space 112. Thus, the people can enjoy sunshine, a gentle breeze and so on from the open space 112.

Further, in the case where an influence of the shade due to the second movable roof structure 115 which is located at the other end of the space 112 is exerted on the space 112 for the reason that the sun is located at a lower position or the like, or in the case where there is a fear of the shade, the driving mechanisms (not shown) located at the both lower ends of the second movable roof structure 115 are operated to downwardly move the second movable roof structure 115 along the inclined surfaces 122 and 122 of the respective stationary support structures 111 and 111. As a result, the second movable roof structure 115 is moved away from the upper portion of the space 112. Thus, the portion of the stadium 112 except for the movable roof units 116 through 118 which are moved to their open position and which are overlapped with each other, and except for the second movable roof structure 115 which is moved to its open position, is open entirely. Accordingly, the shade area or region within the space 112 due to the roof arrangement can be reduced to the utmost so that it is possible to restrain, to the utmost, an influence of the shade with respect to the people which has a match or which watches a game.

Moreover, the upper portion of the space 112 can be made large whereby it is possible to restrain, to the utmost, turbulent flow formed due to bending of the surrounding wind by the roof arrangement or the like. Likewise, it is also possible to restrain, to the utmost, an influence due to the wind.

Furthermore, in order to move the roof arrangement from the above-mentioned open position to the closed position shown in FIG. 1, the movable roof units 116 through 118 and the second movable roof unit 115 should be moved in a direction which is opposite to the above-mentioned direction.

As described above, according to the openable roof apparatus 100 constructed as described above, the movable roof units 116 through 118 and the second movable roof structure 115 are moved in the extending direction of the pair of stationary support structures 111 and 111, whereby it is made possible to move the movable roof units 116 through 118 and the second movable roof structure 115 between the open and closed positions. Thus, opening and closure of the upper portion of the space 112 can freely and simply be done so that it is possible to cope with weather at person's beck and call.

Further, the second movable roof structure 115 is so constructed as to be movable with respect to the space 112. Accordingly, in the case where there is such a fear that an influence of the shade is exerted upon the space 112 for the reason that the sun is located at the lower position, the second movable roof structure 115 is moved from the closed position on the space 112 to the open position indicated by the broken lines in FIG. 3, whereby it is possible to restrain the influence of the shade to the utmost.

In connection with the above, various variations or modifications can be made to the openable roof apparatus 100. For example, the configuration of each of the movable roof units 116 through 118 and the second movable roof structure 115 are optional. Moreover, although the second movable roof structure 115 located at the other end of the space 112 is so constructed as to be moved between the open and closed positions as a whole, if an inlet or entrance is formed in the second movable roof structure 115, only an upper end portion thereof may be moved between the open and closed positions.

Figure 4:
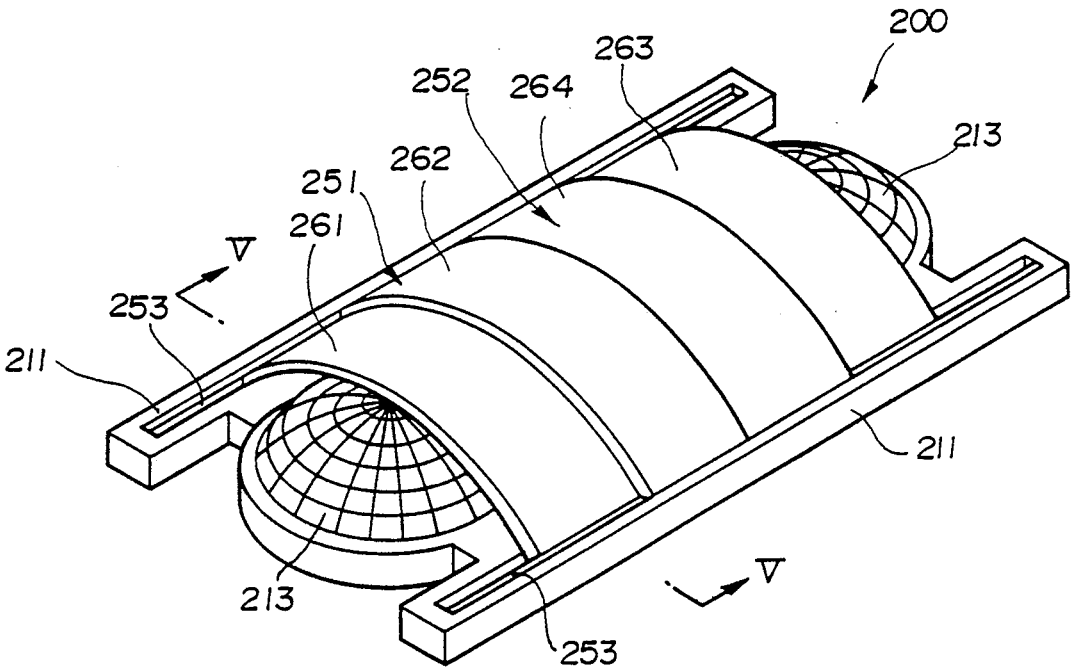
FIG. 4 is a perspective view showing an entire construction of openable roof apparatus according to a second embodiment of the invention, showing first and second movable roof structure to a closed position.

Referring next to FIG. 4, there is shown, in a perspective view, an openable roof apparatus, generally designated by the reference numeral 200, according to a second embodiment of the invention, which is applied to a space 212 (refer to FIG. 5) such as a stadium. The openable roof apparatus 200 comprises a movable roof arrangement which covers an upper portion of the space 212, similarly to the first embodiment described with reference to FIGS. 1 through 3.

The space 212 is, for example, one in which a plurality of audience seats are provided around a sports stadium. In this second embodiment, the space 212 is formed into an ellipse, like the first embodiment shown in FIGS. 1 through 3.

A pair of stationary parallel support structures 211 and 211 are arranged respectively on both sides of the space 212 and extend in parallel relation to each other. The movable roof arrangement comprises a first and a second movable roof structures 251 and 252. The first and second movable roof structures 251 and 252 have their respective both ends which are supported respectively by the pair of stationary support structures 211 and 211 for movement therealong. A pair of guide arrangements 253 and 253 are arranged respectively on the pair of stationary support structures 211 and 211 and extend perpendicularly to a plane including the central axis of the space 212. The first and second movable roof structures 251 and 252 are movable toward and away from each other along the pair of guide arrangements 253 and 253.

The first movable roof structure 251 includes a plurality of movable roof units 261 and 262 having their respective axes which extend perpendicularly to the pair of guide arrangements 253 and 253. The second movable roof structure 252 also includes a plurality of movable roof units 263 and 264 which have their respective axes which extend perpendicularly to the pair of guide arrangements 253 and 253. The movable roof units 261 through 264 of the first and second movable roof structures 251 and 252 have their respective both ends which are supported respectively by the pair of stationary support structures 211 and 211 such that the movable roof units 261 through 264 are movable in the extending direction of the pair of stationary support structures 211 and 211.

The first and second movable roof structures 251 and 252 are movable between a closed position where the movable roof units 261 through 264 of the first and second movable roof structures 251 and 252 cooperate with each other to close the space 212, and an open position where the movable roof units 261 through 264 of the first and second movable roof structures 251 and 252 are moved away from each other to open the space 212.

Figure 5:
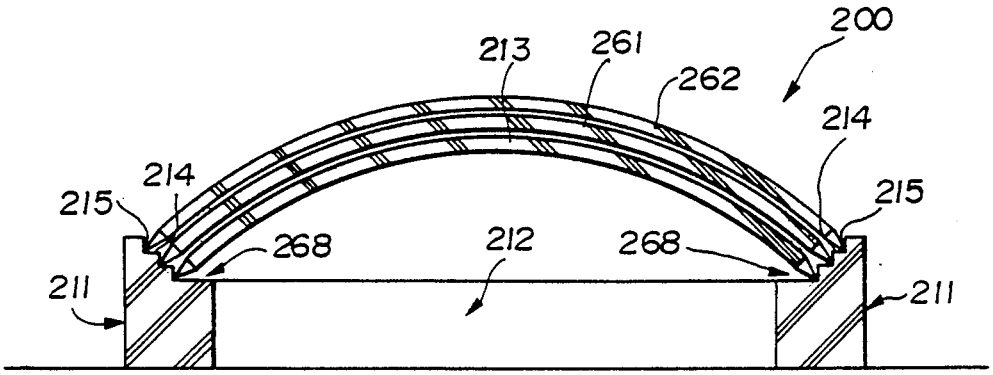
FIG. 5 is an enlarged cross-sectional view taken along the line V—V in FIG. 4.

In the open position, as shown in FIG. 5, the movable roof units 261 and 262 of the first movable roof structure 251 are overlapped with each other. Likewise, the movable roof units 263 and 264 of the second movable roof structure 252 are overlapped with each other. In the closed position, the movable roof units 261 through 264 of the first and second movable roof structures 251 and 252 are formed generally into an ellipse. Each of the first and second movable roof units 261 through 264 of the respective first and second movable roof structures 251 and 252 has an arcuate cross-sectional shape that is a division of a spherical surface.

A pair of stationary roof structures 213 and 213 are arranged respectively on both sides of the space 212 and extend between the pair of stationary support structures 211 and 211 perpendicularly thereto. In the closed position, the pair of stationary roof structures 213 and 213 cooperate with the movable roof units 261 through 264 of the respective first and second movable roof structures 251 and 252 to close the space 212. In the open position, the movable roof units 261 and 262 of the first movable roof structure 251 are overlapped with each other at a location above one of the pair of stationary roof structures 213 and 213. The movable roof units 263 and 264 of the second movable roof structure 252 are overlapped with each other at a location above the other stationary roof structure 213.

In connection with the above, it is preferable that each of the movable roof units 261 through 264 of the first and second movable roof structures 251 and 252 and the pair of stationary roof structures 213 and 213 is of a light weight construction such as a steel truss structure, for example. Further, it is preferable that prestress is introduced into each of the truss structures to restrain deflection of various members or elements at construction or building.

Figure 6:
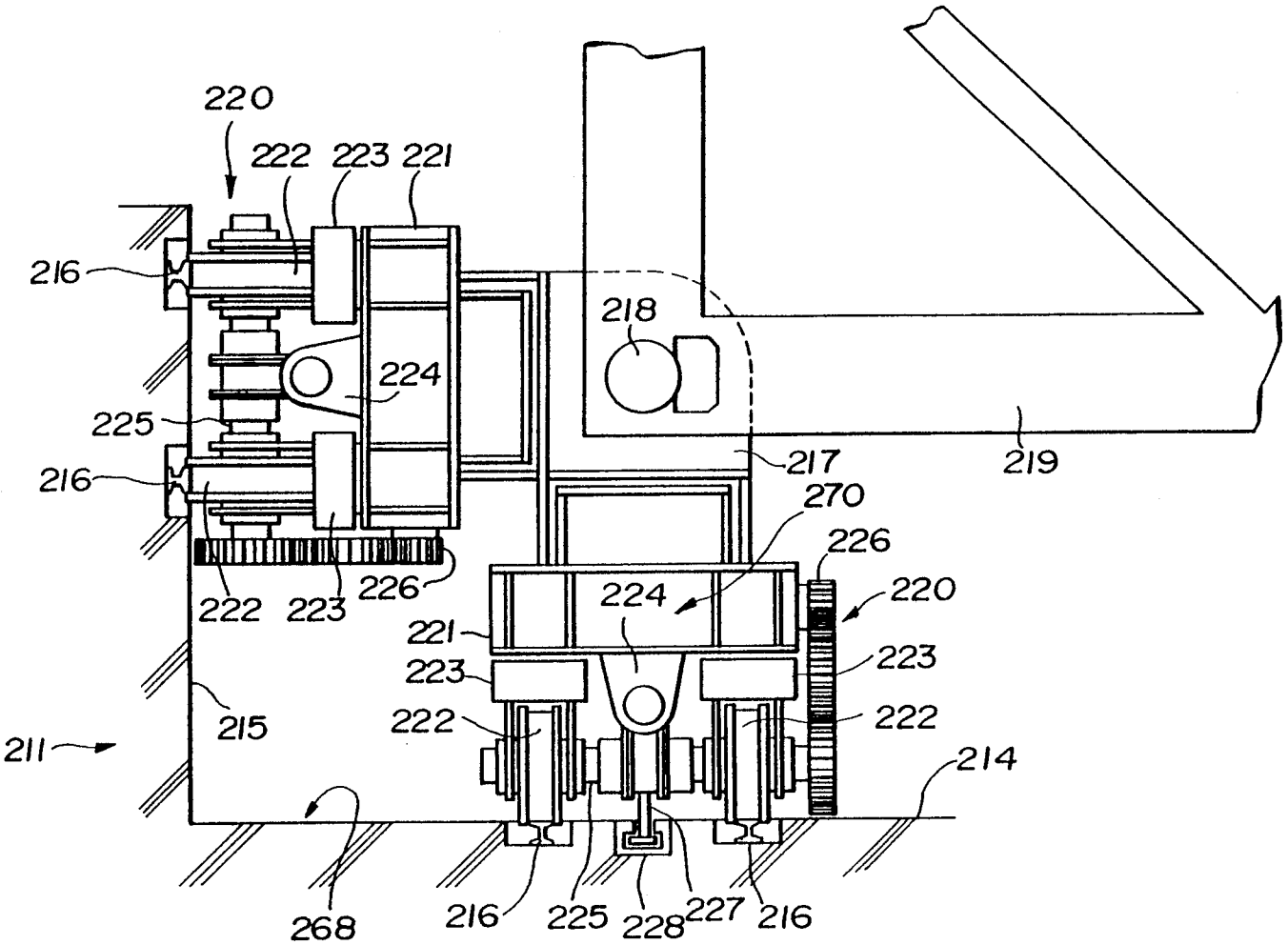
FIG. 6 is an enlarged fragmentary front elevational view of a support for each of movable roof units of the openable apparatus illustrated in FIG. 4.
Figure 7:
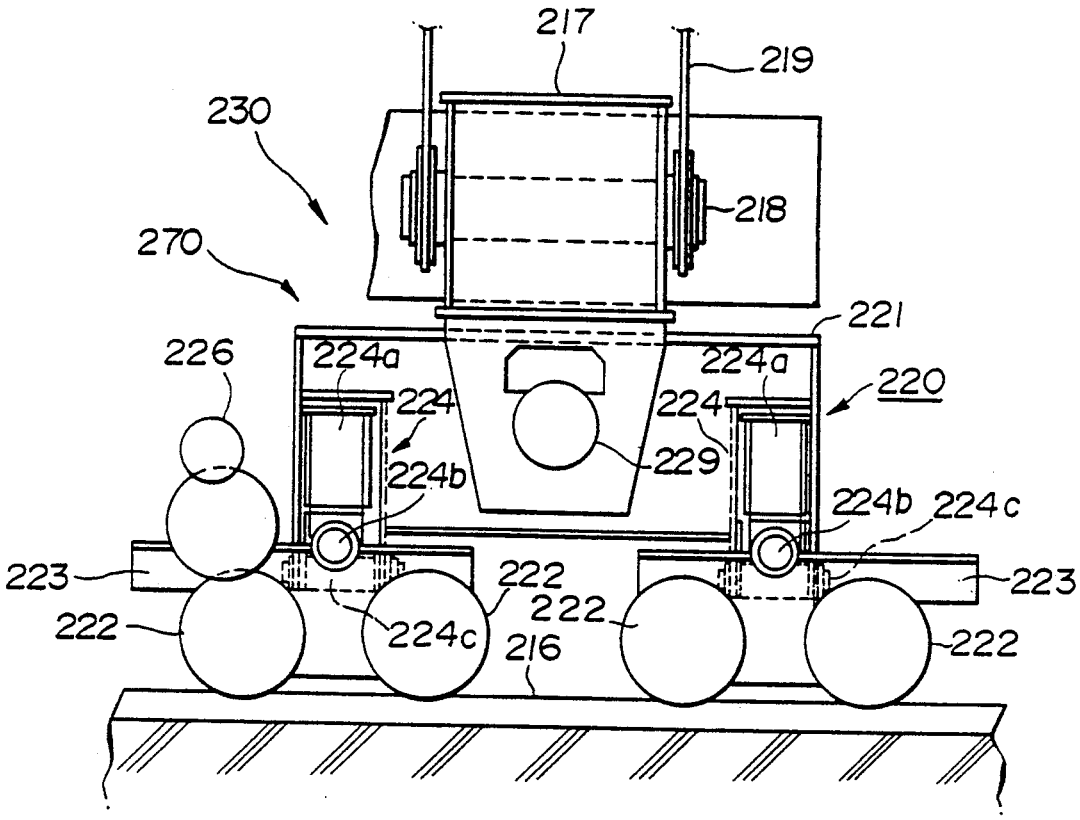
FIG. 7 is a side elevational view of the support arrangement illustrated in FIG. 6.
Figure 19:
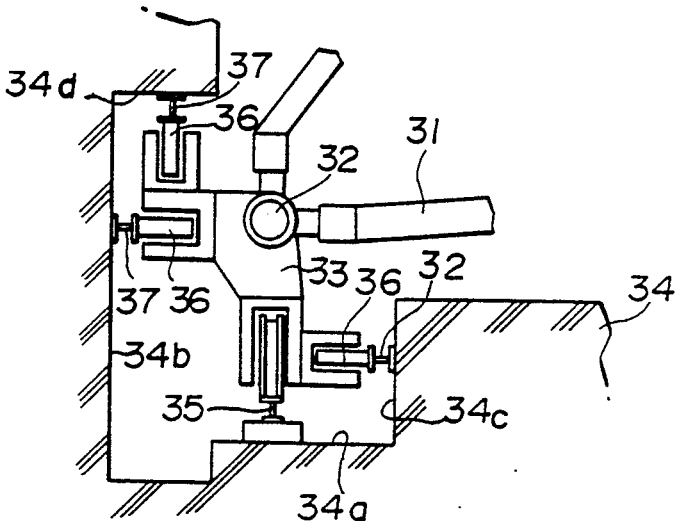
FIG.19 (PRIOR ART)
FIG. 19 is an enlarged fragmentary front elevational view of a support arrangement of another conventional openable roof apparatus.

A support construction for the movable roof units 261 through 264 will be described with reference to FIG. 5. The pair of stationary support structures 211 and 211 have their respective upper surfaces 268 and 268 which are formed respectively into a plurality of steps having a plurality of first surface sections 214 and a plurality of second vertical surface sections 215 extending perpendicularly respectively to the first surface sections 214. In the illustrated second embodiment, the first surface sections 215 extend horizontally. The second vertical surface sections 215 on the respective stationary support structures 211 and 211 are opposed to each other so that the stepped upper surfaces 268 of the respective stationary support structures 211 and 211 diverge toward the first and second movable roof structures 251 and 252. As shown in FIG. 6, each of the pair of guide arrangements 253 and 253 has a plurality of pairs of rails 216. Each two pairs of rails 216 extending in the extending direction of the pair of stationary support structures 211 and 211 are arranged respectively on the first and second surface sections 214 and 215 of the step of the stationary support structure 211.

The movable roof units 261 through 264 of the first and second movable roof structures 251 and 252 have their respective both ends which are the same in structure or construction as each other. Thus, only one of the both ends of the movable roof unit 261 will be described below on behalf of the other movable roof units 262 through 264. The movable roof unit 261 of the first movable roof structure 251 is supported on the two pairs of rails 216 arranged respectively on the first and second surface sections 214 and 215 of the step of the stationary support structure 211.

The end of the movable roof unit 261 has a plurality of pairs of trucks or bogie cars 220. The pair of trucks 220 are supported respectively on the two pairs of rails 216 arranged on the first and second surface sections 214 and 215 of the step of the stationary support structure 211.

Each of the trucks 220 has a base 221 mounted to the end of the movable roof unit 261 and a plurality of wheels 222 supported on the pair of rails 216 and 216. The base 221 has its outer configuration which is like a box. In the illustrated second embodiment, the four pairs of wheels 222 are associated with each of the trucks 220, that is, the total eight wheels 222 are associated with the truck 220. Four support boxes 223 and 223 are provided for supporting respectively the four pairs of wheels 222 and 222 in a rotatable manner. An equalizer-beam arrangement 270 is arranged between the base 221 and the wheels 222. The equalizer-beam arrangement 270 includes a pair of equalizer-beam mechanisms 224 which are interposed between the base 221 and the support boxes 223. The equalizer-beam mechanisms 224 are arranged at the four corners of the base 221. Each of the equalizer-beam mechanisms 224 has a support member 224*a* projecting downwardly to a location below the base 221 and a pair of pins 224*b* and 224*c* which are mounted to a lower end of the support member 224*a*. The pins 224*b* and 224*c* have their respective pivotal axes which extend perpendicularly to each other, that is, in the rotational direction of the wheels 222 and 222 and in the extending direction of the rails 216. The equalizer-beam mechanism 224 disperses equally a load acting upon the base 221 of the truck 220 by pivotal movement of the pins 224*b* and 224*c*.

An axle 225, which is common to the pair of wheels 222 and 222 provided on the right-hand and left- hand sides. The axle 225 has its one end to which engagement between the one end of the axle 225 and a driving mechanism 226 transmits a driving force. The driving mechanism 226 can suitably be controlled in driving and stop by the well-known remote control.

The axle 225 for the truck 220, which is located in parallel relation to the horizontal surface 214 of the stationary support structure 211, is provided with an engaging member 227 whose end has an inverted T-shaped configuration. A guide rail 228 is provided in the horizontal surface 214 and extends in the extending direction of the stationary support structure 211. The inverted T-shaped engaging member 227 is engaged with the guide rail 228. Thus, even if an upward tension force transmitted from the movable roof arrangement acts upon the truck 220, the truck 220 arranged above the horizontal surface 214 is prevented from floating.

The trucks 220 arranged on the horizontal surface 214 and the vertical surface 215 are connected to both ends of a connecting member 217 having its inverted L-shaped configuration, through a pair of pins 229 and 229 which have their respective pivotal axes extending substantially in parallel relation to the rotational axes of the respective wheels 222 and 222. That is, the connecting member 217 is provided which is associated with the end of the movable roof unit 261. The end of the movable roof unit 261 is connected to the connecting member 217 through a first pin 218. The pair of trucks 220 supported respectively on the pairs of rails 216 arranged on the first and second surface sections 214 and 215 of the step of the stationary support structure 211 are connected to the connecting member 217 respectively through the pair of second pins 229.

A major component 219 located at the end of the movable roof unit 261 is connected to the central section of the connecting member 217 through the pin 218 which extends in the extending direction of the stationary support structure 211. Thus, the trucks 220 and 220 arranged on the horizontal and vertical surfaces 214 and 215 are moved in unison through the connecting member 217. By angular movement of the pins 218 and 229, a load acting upon the trucks 220 and 220 from the movable roof unit is dispersed equally. That is, the connecting member 217 and the pins 218 and 229 cooperate with each other to constitute a load dispersing or equalizing mechanism 230 for dispersing equally the load to the trucks 220 and 220.

The operation of the openable roof apparatus 200 according to the second embodiment, constructed as above will be described below.

When the first and second movable roof structures 251 and 252 are moved to the closed position where the movable roof units 261 through 264 are located on the upper portion of the space 212, the movable roof units 261 through 264 cooperate with the pair of stationary roof structures 213 and 213 to cover the upper portion of the space 212 in unison. In this manner, a single large roof arrangement is formed above the space 212. By doing so, the space 212 can take shelter from the rain and wind. Thus, even if it is bad in weather, people can sufficiently enjoy a match or contest and a watch.

On the other hand, in order to move the movable roof structures 251 and 252 to the open position, an operator commands, by remote control, beginning to start operation of the driving mechanisms 226 of the respective trucks 220 which are located at the end of the movable roof unit 261. By doing so, the trucks 220 move along the rails 216 toward the stationary roof structure 213 so that the movable roof units 261 and 262 or 263 and 264 are moved with the movement of the trucks 220. As a result, the movable roof units 261 and 262 or 263 and 264 are moved to a location where the movable roof units 261 and 262 or 263 and 264 are overlapped with each other and with the stationary roof structure 213. In this manner, a portion of the space 212 between the pair of stationary roof structures 213 and 213 is open largely so that the movable roof units 261 through 264 are removed from the portion of the space 212. Thus, the people can enjoy sunshine, a gentle breeze and so on from the open space 212.

At this time, a resultant force of a horizontal force component and a tension force component acts upon the connecting member 217 from the end of the movable roof unit 261, 262, 263 or 264. By the horizontal force component, the movable roof unit 261, 262, 263 or 264 tends to spread out laterally due to its own weight or gravitational weight. By the tension force component, the movable roof unit 261, 262, 263 or 264 tends to be pushed up. Since the movable roof unit 261, 262, 263 or 264 and the connecting member 217 are connected to each other through the pin 218, and since the connecting member 217 and the trucks 220 and 220 are connected to each other through the pins 229 and 229, however, a load applied to the trucks 220 and 220 is equalized by angular movement of the pins 218 and 229. Further, the truck 220 located on the horizontal surface 214 is restricted in its upward movement by engagement between the engaging member 227 and the guide rail 228. Accordingly, the truck 220 is prevented from floating due to the tension force from the movable roof unit 261, 262, 263 or 264.

Moreover, even in the case where the both ends of each of the movable roof units 261 through 264 are not equally moved due to slight deviation or divergence of moving speed, imbalance of a frictional force between the truck 220 and the rails 216, and so on, the horizon of the truck 220 is maintained due to rotational movement of the pin 229. Thus, it is prevented that the truck 220 is separated from the rails 216. Furthermore, even in the case where the load from the connecting member 217 acts only upon one side of the truck 220, the load on each of the wheels 221 is equalized due to rotational movement of the pins **224*b* and 224*c* of the equalizer-beam mechanisms 224**.

Further, in order to move the movable roof units 261 through 264 from the open position to the position illustrated in FIG. 4, that is, to the closed position, the trucks 220 should be moved, by remote control, in a direction which is opposite to that described previously.

As described above, according to the openable roof apparatus 200 constructed as above, movement of the movable roof units 261 through 264 in the extending direction of the pair of stationary roof structures 211 and 211, whereby the first and second movable roof structures 251 and 252 can be moved to the open position. Thus, opening and closure of the upper portion of the space 212 can freely and simply be done so that it is possible to cope with weather at person's beck and call.

Moreover, the both ends of each of the movable roof units 261 through 264 are supported by the pair of trucks 220 and 220. Further, even in the case where the loads from each of the movable roof units 261 through 264 are complicated, the loads can equally be dispersed to the trucks 220 and 220. Thus, even if the movable roof units 261 through 264 are large in size and complicated, the movable roof units 261 through 264 can be moved smoothly and reliable.

Figure 8:
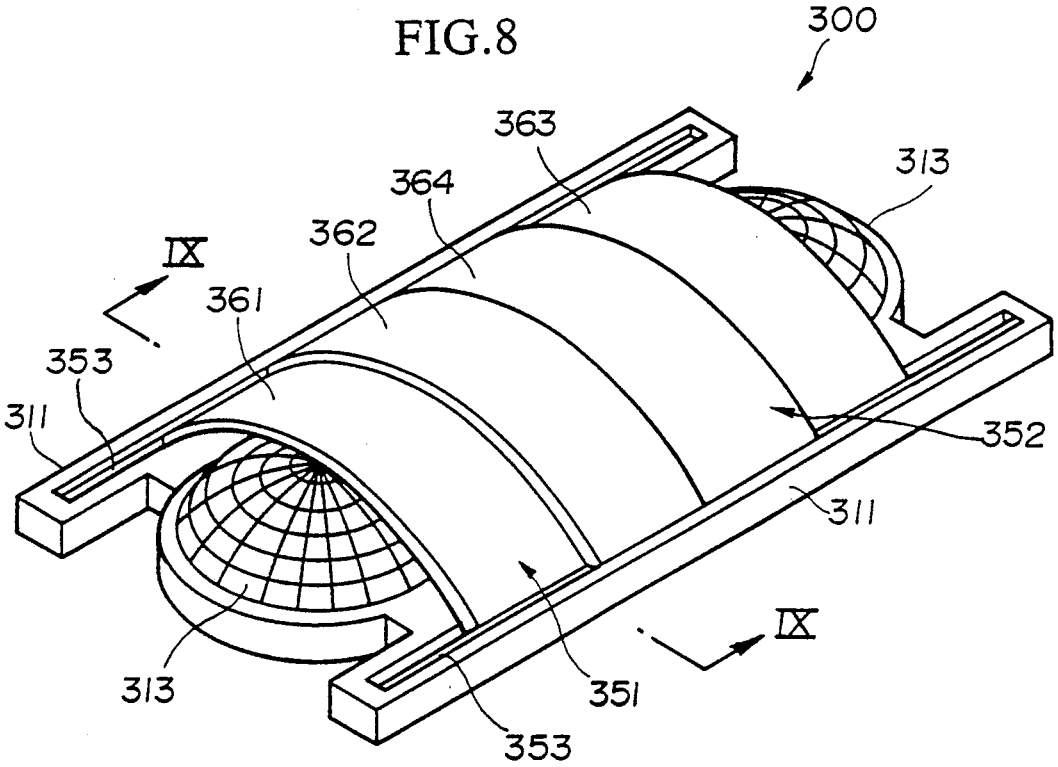
FIG. 8 is a perspective view showing an entire construction of an openable roof apparatus according to a third embodiment of the invention, showing first and second movable roof structures moled to a closed position.

Referring next to FIG. 8, there is shown, in a perspective view, an openable roof apparatus, generally designated by the reference numeral 300, according to a third embodiment of the invention, which is applied to a space 312 (refer to FIG. 9) such as a stadium. The openable roof apparatus 300 comprises a movable roof arrangement which covers an upper portion of the space 312. The space 312 is similar to that of the first embodiment described previously with reference to FIGS. 1 through 3.

A pair of stationary parallel support structures 311 and 311 are arranged respectively on both sides of the space 312 and extend in parallel relation to each other. The movable roof arrangement comprises a first and a second movable roof structures 351 and 352. The first and second movable roof structures 351 and 352 have their respective both ends which are supported respectively by the pair of stationary support structures 311 and 311 for movement therealong. A pair of guide arrangements 353 and 353 are arranged respectively on the pair of stationary support structures 311 and 311 and extend perpendicularly to a plane including the central axis of the space 312. The first and second movable roof structures 351 and 352 are movable toward and away from each other along the pair of guide arrangement 353 and 353.

The first movable roof structure 351 includes a plurality of movable roof units 361 and 362 having their respective axes which extend perpendicularly to the pair of guide arrangements 353 and 353. The second movable roof structure 352 also includes a plurality of movable roof units 363 and 364 which have their respective axes which extend perpendicularly to the pair of guide arrangements 353 and 353. The movable roof units 361 through 364 of the first and second movable roof structures 351 and 352 have their respective both ends which are supported respectively by the pair of stationary support structures 311 and 311 such that the movable roof units 361 through 364 are movable in the extending direction of the pair of stationary support structures 311 and 311.

The first and second movable roof structures 351 and 352 are movable between a closed position where the movable roof units 361 through 364 of the first and second movable roof structures 351 and 352 cooperate with each other to close the space 312, and an open position where the movable roof units 361 through 364 of the first and second movable roof structures 351 and 352 are moved away from each other to open the space 312.

Figure 9:
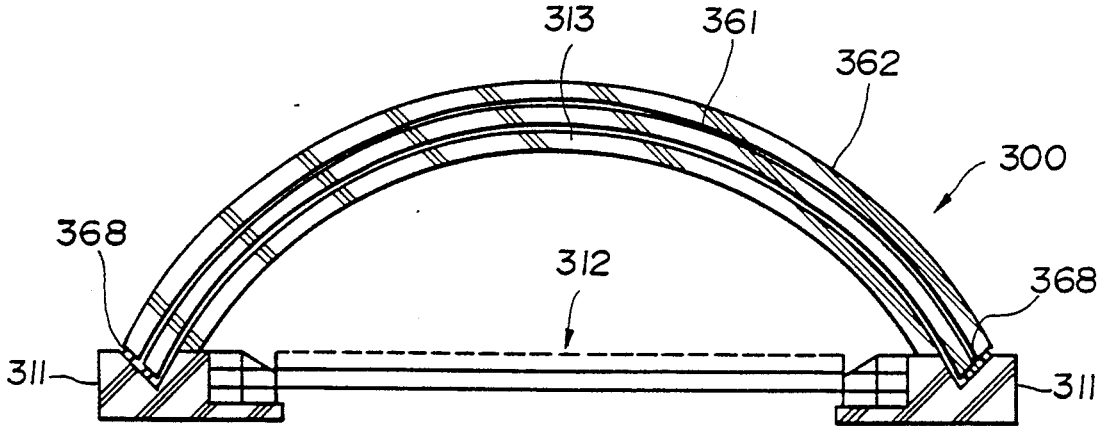
FIG. 9 is an enlarged cross-sectional view taken along the line IX—IX in FIG. 8.
Figure 10:
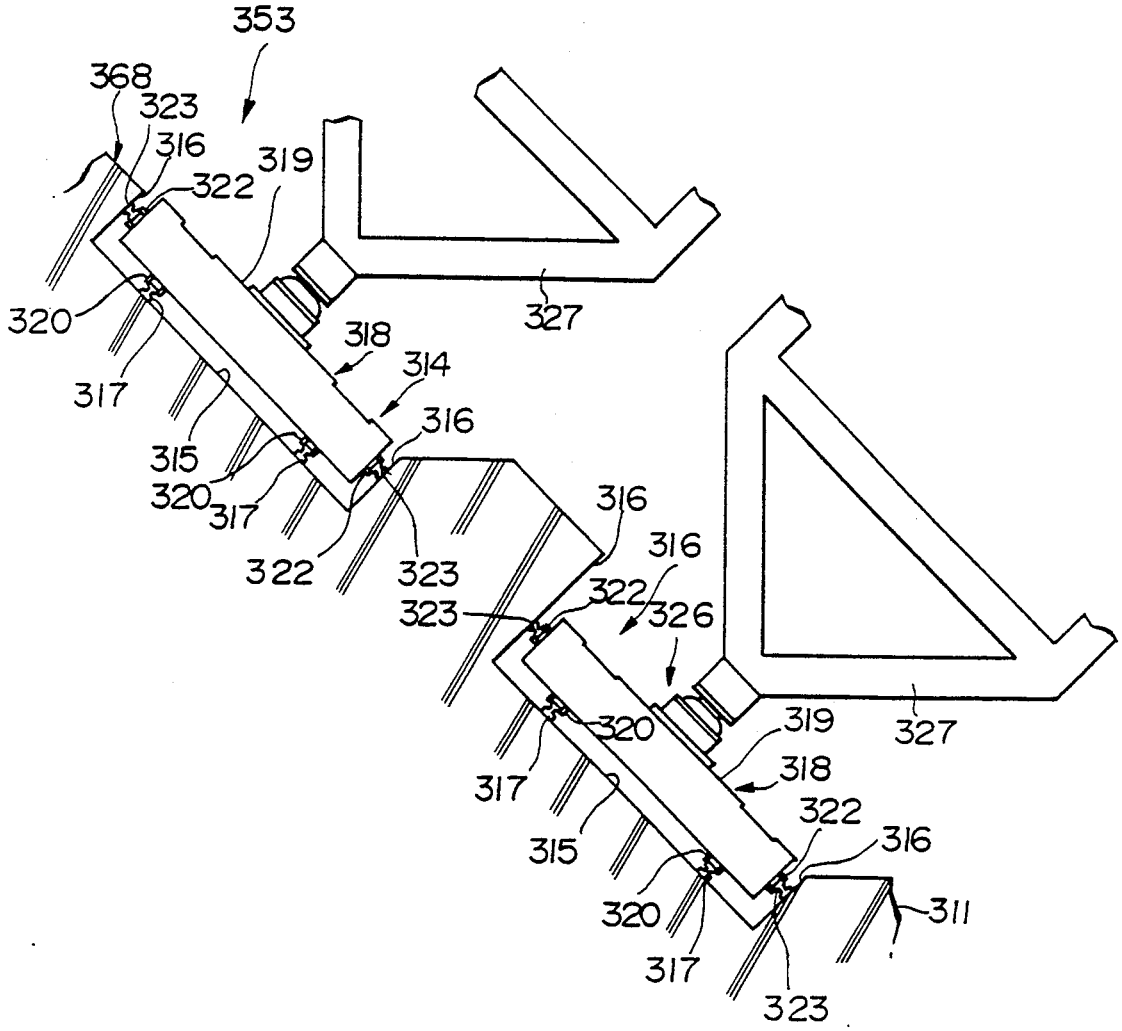
FIG. 10 is an enlarged fragmentary front elevational view of a support arrangement for each of movable roof units of the roof apparatus illustrated in FIG. 8.

In the open position, as shown in FIG. 9, the movable roof units 361 and 362 of the first movable roof structure 351 are overlapped with each other. Likewise, the movable roof units 363 and 364 of the second movable roof structure 352 are overlapped with each other. In the closed position, the movable roof units 361 through 364 of the first and second movable roof structures 351 and 352 are formed generally into an ellipse. Each of the first and second movable roof units 361 through 364 of the respective first and second movable roof structures 351 and 352 has an arcuate cross-sectional shape that is a division of a spherical surface.

A pair of stationary roof structures 313 an 313 are arranged respectively on both sides of the space 312 and extend between the pair of stationary support structures 311 and 311 perpendicularly thereto. In the closed position, the pair of stationary roof structures 313 and 313 cooperate with the movable roof units 361 through 364 of the respective first and second movable roof structures 351 and 352 to close the space 312. In the open position, the movable roof units 361 and 362 of the first movable roof structure 351 are overlapped with each other at a location above one of the pair of stationary roof structures 313 and 313. The movable roof units 363 and 364 of the second movable roof structure 352 are overlapped with each other at a location above the other stationary roof structure 313.

As described above, the movable roof units 361 through 364 are the same in construction or structure as those of the second embodiment described with reference to FIGS. 4 through 7.

A support construction for the movable roof units 361 through 364 will be described with reference to FIGS. 10 through 13. The pair of stationary support structures 311 and 311 have their respective upper surfaces 368 and 368. Each of the pair of guide arrangements 353 and 353 has a plurality of grooves 314 formed in the upper surfaces 368 and 368 of the respective support structures 311 and 311. A plurality of trucks or bogie cars 318 are provided each of which is associated with a corresponding one of the both ends of a corresponding one of the movable roof units 361 through 364. The plurality of trucks 318 are received respectively in the plurality of grooves 314 for movement therealong between the open and closed positions. Each of the grooves 314 has a bottom surface 315 extending perpendicularly to an extension of the end of the movable roof unit 361, 362, 363 or 364, and a pair of side surfaces 316 and 316 extending perpendicularly to the bottom surface 315 and along the extension of the end of the movable roof unit 361, 362, 363 or 364. A plurality of pairs of rails 317 are arranged respectively on the bottom surfaces 315 of the respective grooves 314. Each of the plurality of trucks 318 is supported within the of groove 314 for movement therealong between the open and closed positions. The pair of rails 317 extend in parallel relation to each other.

Each of the trucks 314 has a base 319 connected to the end of the movable roof unit 361, 362, 363 or 364. The base 319 has its size or configuration which is substantially like a box and which is capable of being received in the groove 314. A plurality of wheels 320 are mounted to and engaged with the rails 317 and are supported on the rails 317. An electrically- driven driving mechanism 321 gives its driving force to the wheels 320. The driving mechanism 321 is suitably controllable in its driving and stop by remote control.

A plurality of second rails 323 are arranged respectively on the side surfaces 316 of the respective grooves 314. The second rails 323 extend in the extending direction of the pair of stationary support structures 311 and 311. Each of the trucks 318 has a plurality of pairs of second wheels 322 mounted to the base 319 and supported respectively on the second rails 323. With the above arrangement, the trucks 318 can stably be moved in the groove 314, and there are no such fears that the horizontal force and the tension force from the movable roof units 361, 362, 363 or 364 cause the trucks 318 to be turned over.

Figure 13:
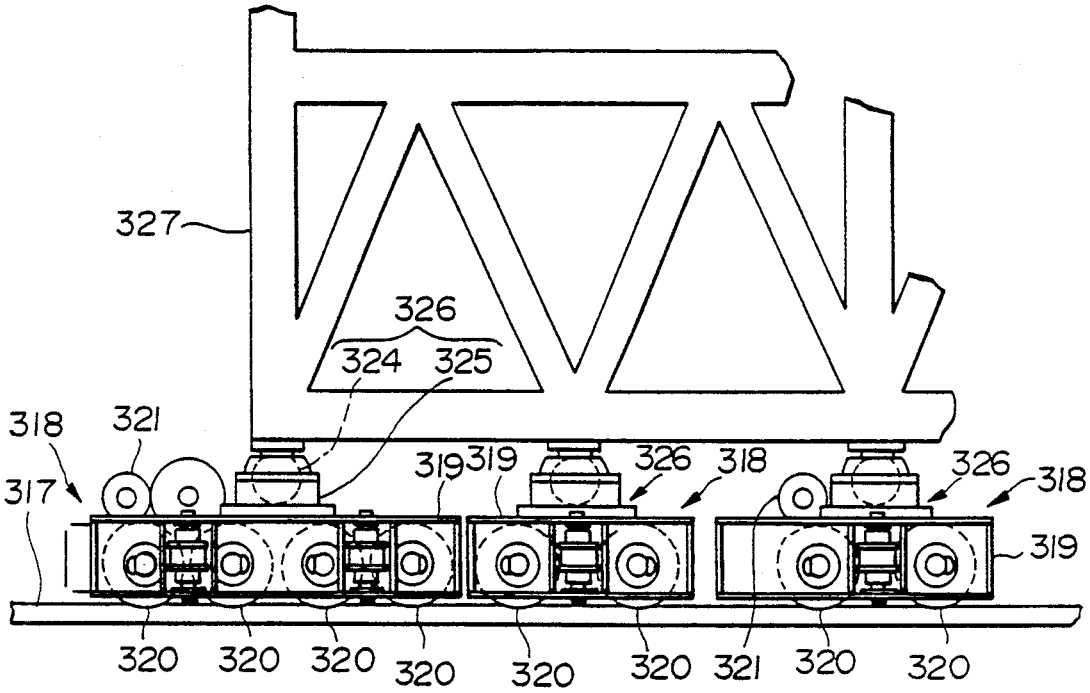
FIG. 13 is an enlarged fragmentary side elevational view of the support arrangement for the movable roof unit of the openable illustrated in FIG. 8.
Figure 20:
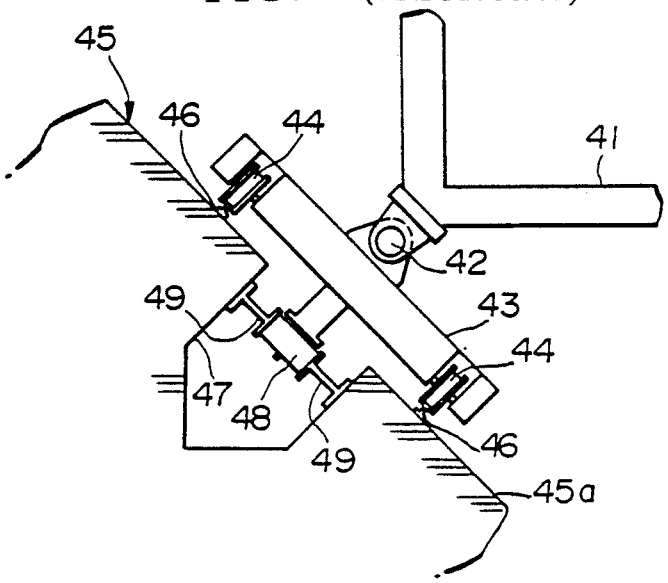
FIG.20 (PRIOR ART)
FIG. 20 is an enlarged fragmentary front elevational view of a support arrangement of still another conventional openable roof apparatus.

Each of the movable roof units 361 through 364 comprises a main member 327 which is located at the end of the movable roof unit. As shown in FIG. 13, each of the both ends of the movable roof unit 361, 362, 363 or 364 has its lower end at which a spherical body 324 is provided. A receiving section 325 for supporting the spherical body 324 in a rollable manner is provided on the upper surface of the base 319 of the truck 318. The spherical body 324 and the receiving section 325 cooperate with each other to form a pivot arrangement 326. By the pivot arrangement 326, the end of the movable roof unit 361, 362, 363 or 364 is pivoted onto the trucks 318. Thus, the movable roof units 361 through 364 are movable in the extending direction of the pair of stationary support structures 311 and 311.

Figure 11:
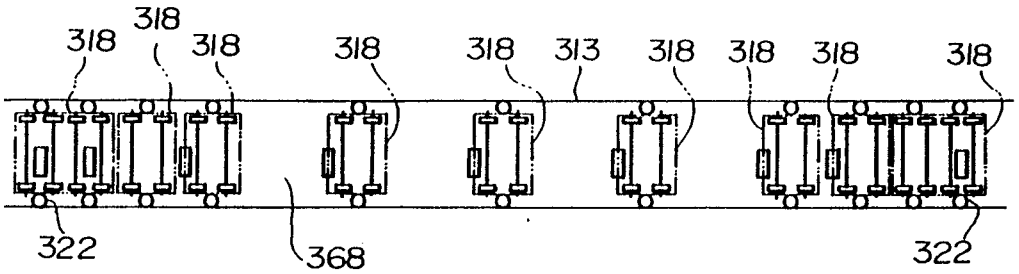
FIG. 11 is a top plan view of an end of the movable roof unit in FIG. 8.
Figure 12:
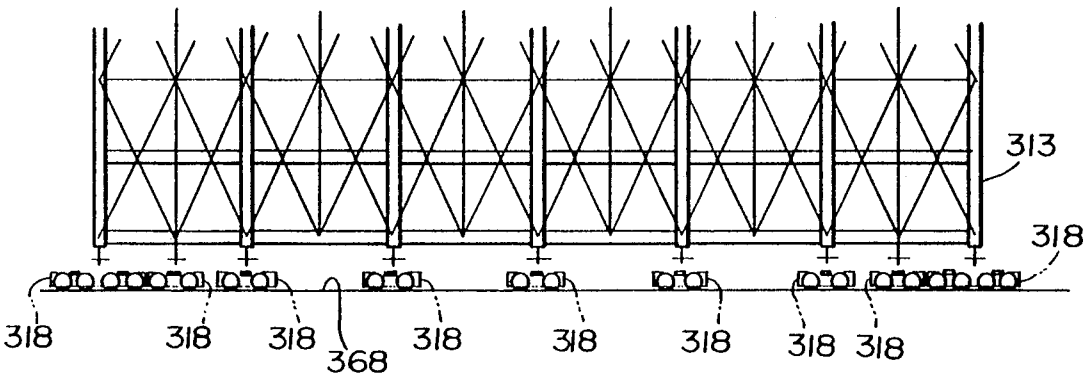
FIG. 12 is a side elevational view of the end of the movable roof illustrated in FIG. 11.

In connection with the above, as shown in FIGS. 11 through 13, the trucks 318 are arranged in a close or intimate fashion at the end of each of the movable roof units 361 through 364 in the moving direction thereof. The eight (8) wheels 320 are mounted to the truck 318 located at the end of the group of trucks in the moving direction. The four (4) wheels 320 are arranged on each of the trucks 318 other than the truck 318 located at the end of the group of trucks. Thus, the reaction force from each of the movable roof units 361 through 364 are effectively received by the wheels 320.

The operation of the openable roof apparatus 300 according to the third embodiment, constructed as above will be described below.

When the first and second movable roof structures 351 and 352 are moved to the closed position where the movable roof units 361 through 364 are located on the upper portion of the space 312, the movable roof units 361 through 364 cooperate with the pair of stationary roof structures 313 and 313 to cover the upper portion of the space 312 in unison. In this manner, a single large roof arrangement is formed above the space 312. By doing so, the space 312 can take shelter from the rain and wind. Thus, even if it is bad in weather, people can sufficiently enjoy a match or contest and a watch.

On the other hand, in order to move the movable roof structures 351 and 352 to the open position, an operator commands, by remote control, beginning to start operation of the driving mechanisms 321 for the trucks 318 which are located at each of the ends of the movable roof units 361 through 364. By doing so, the trucks 318 move along the rails 317 and 323 toward each of the stationary roof structures 313 and 313 so that the movable roof units 361 through 364 are moved with the movement of the trucks 318. As a result, the two pairs of movable roof units 361 and 362 and 363 and 364 are moved away from each other to their respective locations where the movable roof units 361 and 362 and 363 and 364 are overlapped respectively with each other and with the stationary roof structures 313 and 313. Thus, a portion of the space 312 between the stationary roof structures 313 and 313 is open largely so that the movable roof units 361 through 364 are removed from the portion of the space 312. Thus, the people can enjoy sunshine, a gentle breeze and so on from the open space 312.

At this time, a resultant force of a horizontal force component and a tension force component acts upon the trucks 318 from the both ends of the respective movable roof units 361 through 364. By the horizontal force component, the movable roof units 361 through 364 tend to spread out laterally due to their own weight or gravitational weight. By the tension force component, the movable roof units 361 through 364 tend to be pushed up. Since each of the movable roof units 361 through 364 and each of the trucks 318 are connected to each other through the pivot arrangement 326, however, a load applied to the truck 318 is equalized by rolling movement of the spherical body 324 of the pivot arrangement 326. Further, the truck 318 is restrained in its left-hand and right-hand movement by engagement between the guide rails 323 and 323 laid on the groove 316 and the wheels 322 on the respective side surfaces of the truck 318. Accordingly, the truck 318 is prevented from being turned over due to the horizontal force and the tension force from the movable roof unit 361, 362, 363 or 364.

Moreover, even in the case where the both ends of each of the movable roof units 361 through 364 are not equally moved due to slight deviation or divergence of moving speed, imbalance of a frictional force between the truck 318 and the rails 317, and so on, the horizon of the truck 318 is maintained due to rolling movement of the spherical body 324. Thus, it is prevented that the truck 318 is separated from the rails 317.

Further, in order to move the movable roof units 361 through 364 from the open position to the position illustrated in FIG. 8, that is, to the closed position, the trucks 318 should be moved, by remote control, in a direction which is opposite to that described previously.

As described above, according to the openable roof apparatus 300 constructed as above, movement of the movable roof units 361 through 364 in the extending direction of the pair of stationary support structures 311 and 311, whereby the first and second movable roof structures 351 and 352 can be moved to the open position. Thus, opening and closure of the upper portion of the space 312 can freely and simply be done so that it is possible to cope with weather at person's beck and call.

Moreover, since the both ends of each of the movable roof units 361 through 364 are supported by the pair of trucks 318 and 318, the support construction or arrangement can be made simple and can be reduced in weight. Further, even in the case where the loads from the movable roof units 361 through 364 are complicated, the loads can smoothly be transmitted to the trucks 318 and 318. Thus, even if the movable roof units 361 through 364 are large in size and complicated, the movable roof units 361 through 364 can be moved smoothly and reliably.

Figure 14:
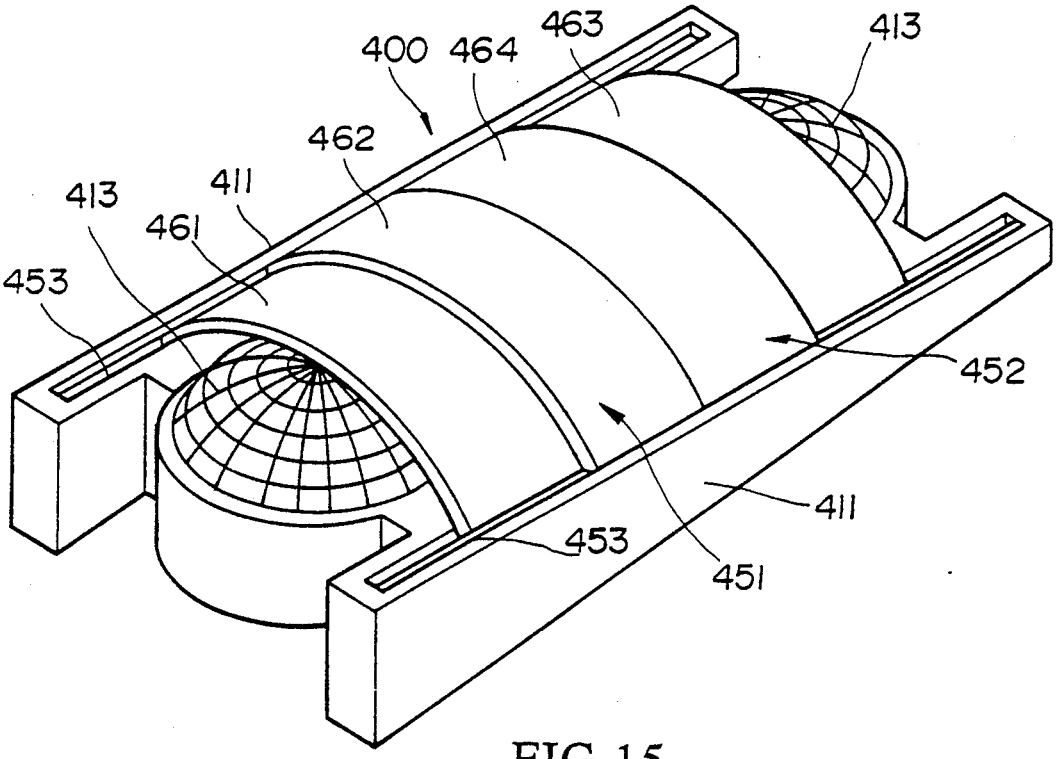
FIG. 14 is a perspective view showing an entire construction of an openable roof apparatus according to a fourth the invention.
Figure 15:
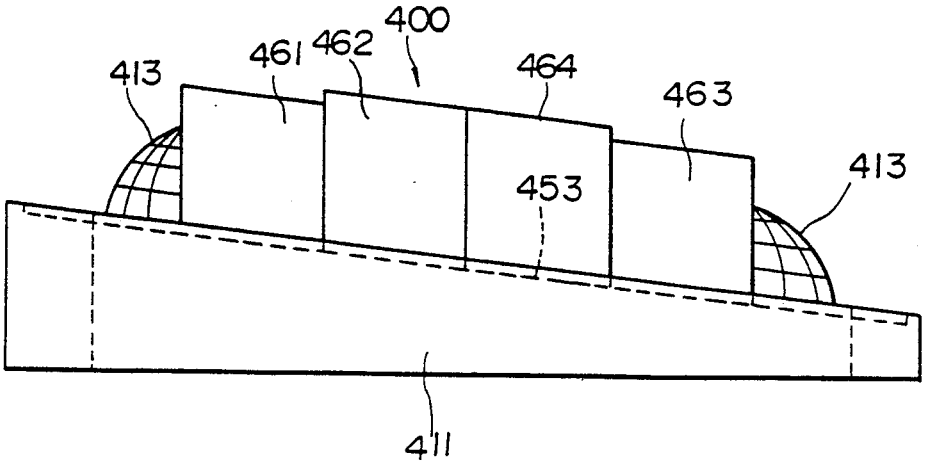
FIG. 15 is a side elevational view of the openable roof apparatus illustrated in FIG. 14.
Figure 16:
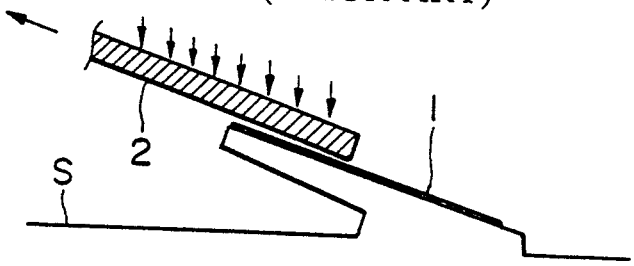
FIG.16 (PRIOR ART)
FIG. 16 is a cross-sectional side elevational view of the conventional openable roof apparatus.
Figure 17:
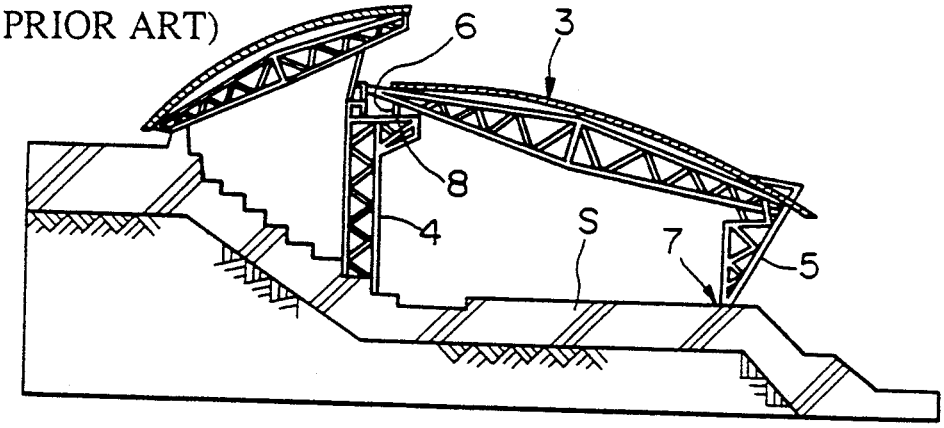
FIG.17 (PRIOR ART)
FIG. 17 is a cross-sectional side elevational view showing another openable roof apparatus.
Figure 18:
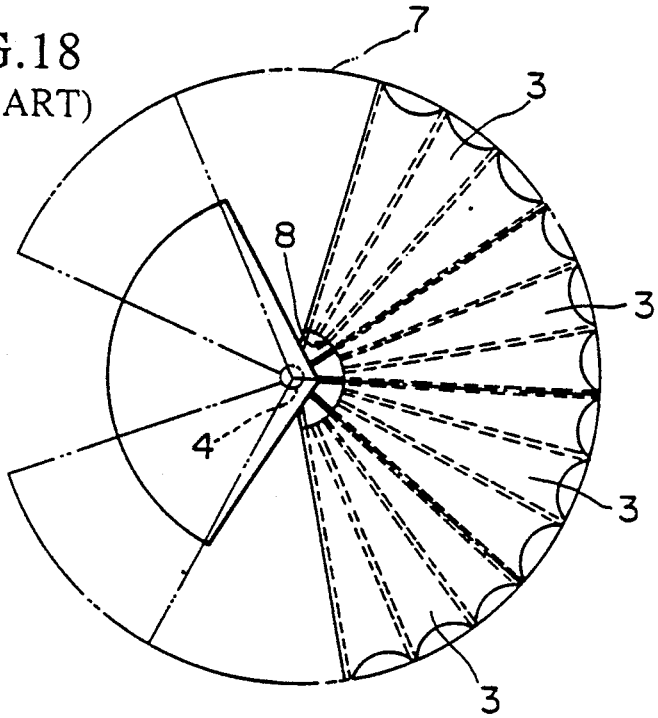
FIG.18 (PRIOR ART)
FIG. 18 is a top plan view of the openable roof apparatus illustrated in FIG. 17.

Referring next to FIG. 14, there is shown, in a perspective view, an openable roof apparatus, generally designated by the reference numeral 400, according to a fourth embodiment of the invention, which is applied to a space such as a stadium. The openable roof apparatus 400 comprises a pair of first and second movable roof structures 451 and 452 which cooperate with each other to cover an upper portion of the space. The space is similar to that of the second embodiment described previously with reference to FIGS. 4 through 7.

A pair of stationary parallel support structures 411 and 411 are arranged respectively on both sides of the space and extending in parallel relation to each other. The first and second movable roof structures 451 and 452 have their respective both ends which are supported respectively by the pair of stationary support structures 411 and 411 for movement therealong. A pair of guide arrangements 453 and 453 are arranged respectively on the pair of stationary support structures 411 and 411 and extend perpendicularly and obliquely to a plane including the central axis of the space. The first and second movable roof structures 451 and 452 are movable toward and away from each other along the pair of guide arrangements 453 and 453.

The first movable roof structure 451 includes a plurality of movable roof units 461 and 462 having their respective axes which extend perpendicularly to the pair of guide arrangements 453 and 453. The second movable roof structure 452 also includes a plurality of movable roof units 463 and 464 which have their respective axes which extend perpendicularly to the pair of guide arrangements 453 and 453. The movable roof units 461 through 464 of the first and second movable roof structures 451 and 452 have their respective both ends which are supported respectively by the pair of stationary support structures 411 and 411 such that the movable roof units 461 through 464 are movable in the extending direction of the pair of stationary support structures 411 and 411.

The first and second movable roof structures 451 and 452 are movable between a closed position where the movable roof units 461 through 464 of the first and second movable roof structures 451 and 452 cooperate with each other to close the space, and an open position where the movable roof units 461 through 464 of the first and second movable roof structures 451 and 452 are moved away from each other to open the space.

In the open position, the movable roof units 461 and 462 of the first movable roof structure 451 are overlapped with each other. Likewise, the movable roof units 463 and 464 of the second movable roof structure 452 are overlapped with each other. In the closed position, the 463 and 464 of the second movable roof structure 452 are overlapped with each other. In the closed position, the movable roof units 461 through 464 of the first and second movable roof structures 451 and 452 are formed generally into an ellipse. Each of the first and second movable roof units 461 through 464 of the respective first and second movable roof structures 451 and 452 has an arcuate cross-sectional shape that is a division of a spherical surface.

A pair of stationary roof structures 413 and 413 are arranged respectively on both sides of the space and extend between the pair of stationary support structures 411 and 411 perpendicularly thereto. In the closed position, the pair of stationary roof structures 413 and 413 cooperate with the movable roof units 461 through 464 of the respective first and second movable roof structures 451 and 452 to close the space. In the open position, the movable roof units 461 and 462 of the first movable roof structure 451 are overlapped with each other at a location above one of the pair of stationary roof structures 413 and 413. The movable roof units 463 and 464 of the second movable roof structure 452 are overlapped with each other at a location above the other stationary roof structure 413.

The movable roof units 461 through 464 are the same in construction or structure as those of the second and third embodiments described with reference to FIGS. 4 through 7 and 8 through 13. The guide arrangements 453 and 453 are similar in construction to the guide arrangements 253 and 253 of the second embodiment illustrated in FIGS. 4 through 7 and to the guide arrangements 353 and 353 of the third embodiment illustrated in FIGS. 8 through 13. However, the guide arrangements 453 and 453 have their respective upper surfaces which are inclined with respect to a horizontal plane.

It will be seen that the fourth embodiment can obtain functional advantages similar to those obtained in the second and third embodiments described with reference to FIGS. 4 through and 8 through 13.

What is claimed is:

1. An openable roof apparatus for a space having a central axis, comprising:

a pair of stationary parallel support structures arranged respectively on both sides of said space and extending in parallel relation to each other;

a first and a second movable roof structures having their respective both ends which are supported respectively by said pair of stationary support structures for movement therealong; and a pair of guide means arranged respectively on said pair of stationary support structures and extending perpendicularly to a plane including the central axis of said space, said first and second movable roof structures being movable toward and away from each other along said pair of guide means, wherein said first movable roof structure includes a plurality of movable roof units having their respective axes which extend perpendicularly to said pair of guide means, wherein said first and second movable roof structures are movable between a closed position where said movable roof units of said first movable roof structure cooperate with said second movable roof structure to close said space, and an open position where said movable roof units of said first movable roof structure are moved away from said second movable roof structure to open said space, wherein, in said open position, said movable roof units of said first movable roof structure are overlapped with each other, wherein said second movable roof structure includes a plurality of movable roof units which, in said open position, are overlapped with each other, wherein said pair of stationary support structures extend in one direction in parallel relation to each other, said pair of stationary support structures being formed respectively with surface means extending in said one direction, wherein said openable roof apparatus further includes a pair of truck means supported respectively by said surface means of the respective stationary support structures and movable respectively along said surface means, the both ends of said respective first and second movable roof structures being supported respectively by said pair of truck means, and a pair of load-equalizing means arranged respectively between said pair of truck means and the both ends of the respective first and second movable roof structure for equalizing loads applied respectively to said pair of truck means, and wherein each end of each of the first and second movable roof structures has an inverted T-shaped engaging means, and each of the stationary support structures has guide rail means, said inverted T-shaped engaging means being engaged with said guide rail means to prevent the truck means from floating away from the stationary support structures.

2. The openable roof apparatus according to claim 1, wherein the surface means of each of said pair of stationary support structures has a horizontal surface and a vertical surface, and wherein said pair of truck means are supported respectively by the horizontal and vertical surfaces of the respective surface means.

3. The openable roof apparatus according to claim 1, further including two pairs of rail means arranged respectively on said horizontal surfaces of said surface means of the respective stationary support structures, and two pairs of second rails.

4. The openable roof apparatus according to claim 1, wherein each of said first and second movable roof structures is formed into an arcuate configuration.

5. The openable roof apparatus according to claim 1, wherein said surface means of the respective stationary support structures are inclined toward each other.

6. The openable roof apparatus according to claim 1, further including a pair of stationary roof structures arranged respectively on both sides of said space and extending between said pair of stationary support structures perpendicularly thereto, wherein, in said closed position, said pair of stationary roof structures cooperate with said movable roof units of the respective first and second movable roof structures to close said space, and wherein, in said open position, said movable roof units of said first movable roof structure are overlapped with each other at a location above one of said pair of stationary roof structures, and said movable roof units of said second movable roof structure are overlapped with each other at a location above the other stationary roof structure.

7. An openable roof apparatus for a space comprising:

a pair of stationary parallel support structures, each of which is arranged on a respective side of said space and extending in a parallel relationship with respect to each other, each of the stationary support structures having a horizontal section and an inclined section inclined with respect to the horizontal section, the horizontal section being longer than the inclined section, a first movable roof structure including a plurality of movable roof units, each of the movable roof units having ends which are supported by said respective horizontal sections of said stationary support structures for movement therealong;

a second movable roof structure having ends which are supported by said respective inclined sections of said stationary support structures for movement therealong; and a pair of guide means, each arranged respectively on said pair of stationary support structures, said first and second movable roof structures being movable toward and away from each other along said pair of guide means, each of the guide means including a plurality of guide rails located on the corresponding horizontal section of said stationary support structure for movement of said movable roof units of said first movable roof structure, each of the guide means further including a rack-type rail located on the corresponding inclined section of said stationary support structure for movement of said movable roof units of said first movable roof structure, whereby said first and second movable roof structures are movable between a closed position where said movable roof units of said first movable roof structure cooperate with said second movable roof structure to close said space, and an open position where said movable units of said first movable roof structure are moved away from said second movable roof structure to open said space, wherein, in said open position, said movable roof units of said first movable roof structure overlap one another.

8. The openable roof apparatus according to claim 7, wherein each of said movable roof units of said first movable roof structure has an arcuate cross-sectional shape that is a division of a spherical surface.

9. The openable roof apparatus according to claim 7, wherein, in said closed position, one of said movable roof units has its side located adjacent a side of said second movable roof unit projects arcuately in plan toward said side of said second movable roof structure, and said side of said second movable roof structure is concave arcuately in plan coresponding to said projecting side of said one movable roof unit.

10. The openable roof apparatus according to claim 7, further including a stationary roof structure arranged on one of both sides of said space at a location on the opposite side of said space from said second movable roof structure, said stationary roof structure extending between said pair of stationary support structures perpendicularly thereto, wherein, in said closed position, said stationary roof structure cooperates with said second movable roof structure and said movable roof units of said first movable roof structure to close said space, and wherein, in said open position, said movable roof units of said first movable roof structure are overlapped with each other at a location above said stationary roof structure.

11. The openable roof apparatus according to claim 7, wherein said second movable roof structure includes a plurality of movable roof units which, in said open position, are overlapped with each other.

12. The openable roof apparatus according to claim 11, wherein said pair of stationary support structures have their respective upper surfaces which are formed respectively into a plurality of steps having a plurality of first surface sections and a plurality of second vertical surface sections extending perpendicularly respectively to said first surface sections, said second vertical surface sections on the respective stationary support structures being opposed to each other so that the stepped upper surfaces of the respective stationary support structures diverge toward said first and second movable roof structures, wherein each of said pair of guide means has a plurality of pairs of rail means each pair of which are arranged respectively on. the first and second surface sections of a corresponding one of the steps of a corresponding one of said pair of stationary support structures, and wherein each of the both ends of each of said movable roof units of said first and second movable roof structures is supported on the pair of rail means arranged respectively on the first and second surface sections of a corresponding one of the steps of a corresponding one of said stationary support structures.

13. The openable roof apparatus according to claim 12, wherein the end of the movable roof unit has a plurality of pairs of truck means which are supported respectively on the pair of rail means arranged on the first and second surface sections of the step of the stationary support structure.

14. The openable roof apparatus according to claim 13, wherein each of said plurality of truck means has a base mounted to the end of the corresponding movable roof units, a plurality of wheels supported on the corresponding rail means, and a equalizer-beam arrangement arranged between the base and the wheels for equally dispersing a load acting upon the base, to the wheels.

15. The openable roof apparatus according to claim 11, wherein said pair of stationary support structures have their respective upper surfaces, wherein each of said pair of guide means has a plurality of groove means formed in a corresponding one of said upper surfaces of the respective support structures, wherein said openable roof apparatus further includes a plurality of truck means each of which is associated with a corresponding one of the both ends of a corresponding one of said movable roof units of said first and second roof structures, and wherein said plurality of truck means are received respectively in said plurality of groove means for movement therealong between said open and closed positions.

16. The opeanable roof apparatus according to claim 15, wherein each of the both ends of each of said movable roof units of the first and second roof structures has one of spherical body means and receiving means therefor, and wherein each of said truck means includes the other of said spherical body means and said receiving means.

17. The openable roof apparatus according to claim 15, wherein each of said plurality of rail means includes a pair of rails extending in parallel relation to each other.

18. An openable roof apparatus for a space having a central axis, comprising:

a pair of stationary parallel support structures arranged respectively on both sides of said space and extending in parallel relation to each other;

a first and a second movable roof structures having their respective both ends which are supported respectively by said pair of stationary support structures for movement therealong; and a pair of guide means arranged respectively on said pair of stationary support structures and extending perpendicularly to a plane including the central axis of said space, said first and second movable roof structures being movable toward and away from each other along said pair of guide means, wherein said first movable roof structure includes a plurality of movable roof units having their respective axes which extend perpendicularly to said pair of guide means, wherein said first and second movable roof structures are movable between a closed position where said movable roof units of said first movable roof structure cooperate with said second movable roof structure to close said space, and an open position where said movable roof units of said first movable roof structure are moved away from said second movable roof structure to open said space, and wherein, in said open position, said movable roof units of said first movable roof structure are overlapped with each other, wherein said second movable roof structure includes a plurality of movable roof units which, in said open position, are overlapped with each other, wherein said pair of stationary support structures have their respective upper surfaces which are formed respectively into a plurality of steps having a plurality of first surface sections and a a plurality of second vertical surface sections extending perpendicularly respectively to said first surface sections, said second vertical surface sections on the respective stationary support structures being opposed to each other so that the stepped upper surfaces of the respective stationary support structures diverge toward said first and second movable roof structures, wherein each of said pair of guide means has a plurality of pairs of rail means each pair of which are arranged respectively on the first and second surface sections of a corresponding one of the steps of a corresponding one of said pair of stationary support structures, wherein each of the both ends of each of said movable roof units of said first and second movable roof structures is supported on the pair of rail means arranged respectively on the first and second surface sections of a corresponding one of the steps of a corresponding one of said stationary support structures, wherein each end of each of the movable roof units has a plurality of pairs of truck means which are supported respectively on the pair of rail means arranged on the first and second surface sections of the step of the stationary support structure, wherein each end of the movable roof units further has an inverted T-shaped engaging means, and each first surface section has guide rail means, said inverted T-shaped engaging means being engaged with said guide rail means to prevent the truck means from floating away from the first surface sections, wherein each of said plurality of truck means has a base mounted to the end of the corresponding movable roof unit, a plurality of wheels supported on the corresponding rail means, and an equalizer-beam arrangement arranged between the base and the wheels for equally dispersing a load acting upon the base, to the wheels.

19. The openable roof apparatus according to claim 18, wherein each of said pairs of rail means includes a pair of rails arranged on a corresponding one of the first and second surface sections of the step of the stationary support structure.

20. The openable roof apparatus according to claim 18, wherein the equalizer-beam arrangement has a pair of pin means whose respective pivotal axes extend perpendicularly to each other.

21. The openable roof apparatus according to claim 18, further includes a plurality of connecting members each of which is associated with a corresponding one of the both ends of a corresponding one of said movable roof units of said first and second movable structures, a plurality of first pin means, the end of the movable roof unit being connected to the connecting member through a corresponding one of said plurality of first pin means, and a plurality of pairs of second pin means, the pair of truck means supported respectively on the pair of rail means arranged on the first and second surface sections of the step of the stationary support structure being connected to the connecting member respectively through a corresponding pair of the plurality of pairs of second pin means.

22. The openable roof apparatus according to claim 18, wherein said first surface sections extend horizontally.

23. The openable roof apparatus according to claim 18, wherein said first surface sections extend in an inclined manner with respect to a horizontal plane.

24. An openable roof apparatus for a space having a central axis, comprising:

a pair of stationary parallel support structures arranged respectively on both sides of said space and extending in parallel relation to each other;

a first and a second movable roof structures having their respective both ends which are supported respectively by said pair of stationary support structures for movement therealong; and a pair of guide means arranged respectively on said pair of stationary support structures and extending perpendicularly to a plane including the central axis of said space, said first and second movable roof structures being movable toward and away from each other along said pair of guide means, wherein said first movable roof structure includes a plurality of movable roof units having their respective axes which extend perpendicularly to said pair of guide means, wherein said first and second movable roof structures are movable between a closed position where said movable roof units of said first movable roof structure cooperate with said second movable roof structure to close said space, and an open position where said movable roof units of said first movable roof structure are moved away from said second movable roof structure to open said space, and wherein, in said open position, said movable roof units of said first movable roof structure are overlapped with each other, wherein, in said open position, said movable roof units of said first movable roof structure are overlapped with each other, wherein said pair of stationary support structures have their respective upper surfaces, wherein each of said pair of guide means has a plurality of groove means formed in a corresponding one of said upper surfaces of the respective support structures, wherein said openable roof apparatus further includes a plurality of truck means each of which is associated with a corresponding one of the both ends of a corresponding one of said movable roof units of said first and second roof structures, and wherein said plurality of truck means are received respectively in said plurality of groove means for movement therealong between said open and closed positions, and wherein each of the both ends of each of said movable roof units of the first and second roof structures has one of spherical body means and receiving means therefor, and wherein each of said truck means includes the other of said spherical body means and said receiving means.

25. The openable roof apparatus according to claim 24, wherein each of said plurality of groove means has a bottom surface extending perpendicularly to an extension of a corresponding one of the both ends of a corresponding one of said movable roof units of said first and second roof structures, and a pair of said surfaces extending perpendicularly to the bottom surface and along the extension of the end of the movable roof unit.

26. The openable roof apparatus according to claim 25, further includes a plurality of rail means arranged respectively on the bottom surfaces of the respective groove means, wherein each of said plurality of truck means is supported on a corresponding one of said plurality of rail means for movement therealong between said open and closed positions.

27. The openable roof apparatus according to claim 26, wherein each of said plurality of truck means has a base connected to a corresponding one of the both ends of a corresponding one of said movable roof units of said first and second roof structures, and a plurality of wheels mounted to the base and supported on a corresponding one of said plurality of rail means.

28. The openable roof apparatus according to claim 27, further includes a plurality of second rail means arranged respectively on the side surfaces of the respective groove means, wherein each of said plurality of truck means has a plurality of pairs of second wheels mounted to the base and supported respectively on the second rail means.

29. The openable roof apparatus according to claim 28, wherein each of the both ends of each of said movable roof units of the first and second roof structures has one of spherical body means and receiving means therefor, and wherein each of said truck means includes the other of said spherical body means and said receiving means.

* * * * *

UNITED STATES PATENT AND TRADEMARK OFFICE

CERTIFICATE OF CORRECTION

PATENT NO. : 5,063,730

DATED : November 12, 1991

INVENTOR(S) : Kiroki Muramoto, et al.

It is certified that error appears in the above-identified patent and that said Letters Patent is hereby corrected as shown below:

Column 5, line 20: "of openable" should read as --of an openable--

Column 5, line 22: "structure to" should read as --structures moved to--

Column 5, line 27: "openable apparatus" should read as --openable roof apparatus--

Column 5, line 33: "moled" should read as --moved--

Column 5, line 39: "the roof" should read as --the openable roof--

Column 5, line 41: "unit in" should read as --unit illustrated in--

Column 5, line 43: "roof illustrated" should read as --roof unit illustrated--

UNITED STATES PATENT AND TRADEMARK OFFICE

CERTIFICATE OF CORRECTION

PATENT NO. : 5,063,730

DATED : November 12, 1991

INVENTOR(S) : Kiroki Muramoto, et al.

It is certified that error appears in the above-identified patent and that said Letters Patent is hereby corrected as shown below:

Column 5, line 46: "openable illustrated" should read as --openable roof apparatus--

Column 5, line 49: "fourth the" should read as --fourth embodiment of the--

Column 5, line 55: "another openable" should read as --another conventional openable--

Column 15, line 9: "an" should read as --and--

Column 18, lines 38-40: delete "In the closed position, the 463 and 464 of the second movable roof structure 452 are overlapped with each other."

Column 19, line 10: "through and" should read as --through 7 and--

Column 21, line 17, Claim 9: "roof unit" should read as --roof structure, and wherein said side of said one movable roof unit--.

Column 21, line 21, Claim 9: "coresponding" should read as --correspondingly--

UNITED STATES PATENT AND TRADEMARK OFFICE

CERTIFICATE OF CORRECTION

PATENT NO. : 5,063,730

DATED : November 12, 1991

INVENTOR(S) : Kiroki Muramoto, et al.

It is certified that error appears in the above-identified patent and that said Letters Patent is hereby corrected as shown below:

Column 22, line 4, Claim 14: "units" should read as --unit--

Column 23, line 34, Claim 18: "sections," should read as --sections, and--

Column 24, lines 34-36: delete "wherein, in said open position, said movable roof units of said first movable roof structure are overlapped with each other."

Column 24, line 62, Claim 25: "said" should read as --side--

Signed and Sealed this

Seventh Day of September, 1993

Bruce Lehman

*Attest:*

BRUCE LEHMAN

*Attesting Officer*

*Commissioner of Patents and Trademarks*